US005273284A

United States Patent [19]

Montgomery

[11] Patent Number: 5,273,284

[45] Date of Patent: Dec. 28, 1993

[54] GOLF PUTTING AID

[75] Inventor: Anthony J. Montgomery, Portland, Oreg.

[73] Assignee: The Golf Team, Inc., Newberg, Oreg.

[21] Appl. No.: 952,356

[22] Filed: Sep. 28, 1992

[51] Int. Cl.[5] ..... A63B 69/36

[52] U.S. Cl. ..... 273/187.6; 273/192

[58] Field of Search ..... 273/192, 191 R, 191 A, 273/191 B, 186.1, 187.6, 183.1

[56] References Cited

U.S. PATENT DOCUMENTS

| | | | |
|---|---|---|---|
| 1,173,384 | 2/1916 | Rees | 273/194 A |
| 2,894,755 | 7/1959 | Scelzo | 273/192 |
| 3,269,733 | 8/1966 | Taddie et al. | 273/192 X |
| 3,375,010 | 3/1968 | Panza | 273/186.1 |
| 3,656,752 | 4/1972 | Moriarity | 273/192 X |
| 3,806,133 | 4/1974 | Cork | 273/192 |
| 4,082,287 | 4/1978 | Berkey | 273/192 X |
| 4,315,626 | 2/1982 | Hamm | 273/186.1 |
| 5,037,100 | 8/1991 | Montgomery | 273/192 X |

*Primary Examiner*—George J. Marlo

*Attorney, Agent, or Firm*—Eugene M. Eckelman

[57] ABSTRACT

A flat plate-like base member is capable of being seated on a supporting surface such as a putting surface. An upstanding pedestal is mounted on the top surface of the base member and has a front surface from which at least one elongated straight rod has cantilevered support in a plane parallel with the base member. The rod is supported at a height whereby a golf ball on the supporting surface and a putter head can be located freely thereunder so that the putter head can be moved into contact with the ball. The rod is of a length whereby the putter head can be moved therealong through a putting stroke while the golfer sights down on the putter head and golf ball in relation to the rod whereby to encourage a straight line impact against the ball. A front surface of the pedestal has a plurality of sockets by means of which selected positioning of the rods can be provided namely, either upper or lower positions relative to the putting surface, a narrowed positioning of the rods to restrict lateral line of sight on the putter head, and vertically aligned positions that provide a vertical viewing of the putter head from directly above.

5 Claims, 2 Drawing Sheets

54
52
48
44
50
16
42
38
32e
12
40
22
4
32
32a
32b
32c
32d
34
36
14
10
20
56
58
60

GOLF PUTTING AID

BACKGROUND OF THE INVENTION

This invention relates to new and useful improvements in putting aids and more particularly is concerned with improvements in the structure shown in my prior U.S. Pat. No. 5,037,100.

My U.S. Pat. No. 5,037,100 was conceived to develop a good putting stroke and more particularly to develop a stroke with the important requisites of moving the putter in a square putting stroke, of accelerating the stroke at the ball, of building a controlled compact stroke with a feeling of alignment, and of injecting these fundamentals into muscle memory and other important requisites. This was accomplished in a structure using a base member having longitudinal guide means along which the putter can be directed whereby the golfer, when viewing a narrow alignment mark on the putter head from above is required to move the putter rearwardly and forwardly in straight line movements. Also, with proper positioning of the ball relative to the base member, a restricted back swing for the putter can be accomplished. These requirements develop the important fundamentals of putting that inject them into the said muscle memory. The longitudinal guide means comprise a pair of guide rods having cantilevered support on the base member above and parallel with the putting surface. These rods extend from the base member in a similar horizontal plane with a clearance space therebetween. This amount of spacing allows an alignment mark on a putter head to be readily sighted thereunder but with some lateral clearance while making a practice putting stroke with the putter.

The lateral clearance, which is wider than the alignment mark on the putter, works well in the usual circumstance but it may be desired by the more experienced golfers, that the guide rods be spaced rather closely to the putting surface to require the putter to move in a minimum arc in its backswing and follow through. Also, it may be desired by the more experienced golfers that the amount of lateral movement of the putter in its guided path be decreased so as to provide a very narrow sighting path for the alignment mark. Furthermore, some golfers may like vertical sighting means that can be used to practice putting with their eyes directly over the ball to form the line of the putt.

SUMMARY OF THE INVENTION

According to the present invention and forming a primary objective thereof, a putting aid is provided that includes substantial improvements in the art.

More particularly, the present putting aid includes a pair of guide rods that ca be located to require the putter to be maintained fairly close to the ground during the practice swing, to provide guide rods that can be located to define a path therebetween which is substantially narrow whereby to develop a critically square putting stroke therebetween, and to provide guide rods that can be located to form vertical sighting means used to practice putting with the eye directly over the ball to form the line of the putt.

Still another object of the invention is to provide an upright pedestal in combination with attachable guide rods that can provide arrangements of putting guides as described above whereby to form different guide or sighting means for a putter.

In general, the invention employs a base member that supports a pedestal in turn capable of supporting elongated rods in outwardly projecting relation parallel with the putting surface. The rods are held at a sufficient height to receive a golf ball and putter head freely thereunder and are of sufficient length to guide the putter head rearwardly and forwardly with the golfer viewing the putter head from above, thus encouraging a straight line movement. Mounting means are provided in the pedestal for selected mounted positioning of a pair of the rods, namely, a mounted position toward the upper portion of the pedestal to provide a generous space for the arc of movement of the putter when the latter is moved in a back-swing and follow-through between the rods and the putting surface, a mounted position of the two rods that is lower than the upper position so as to require a minimum arc of movement of the putter in its backswing and follow-through, a mounted position of the two rods that places the rods fairly close together so that the amount of lateral movement of the putter is very limited, and a mounted position of the two rods that provide vertical sighting means.

DETAILED DESCRIPTION OF A PREFERRED EMBODIMENT

Figures 1, 2, 3:
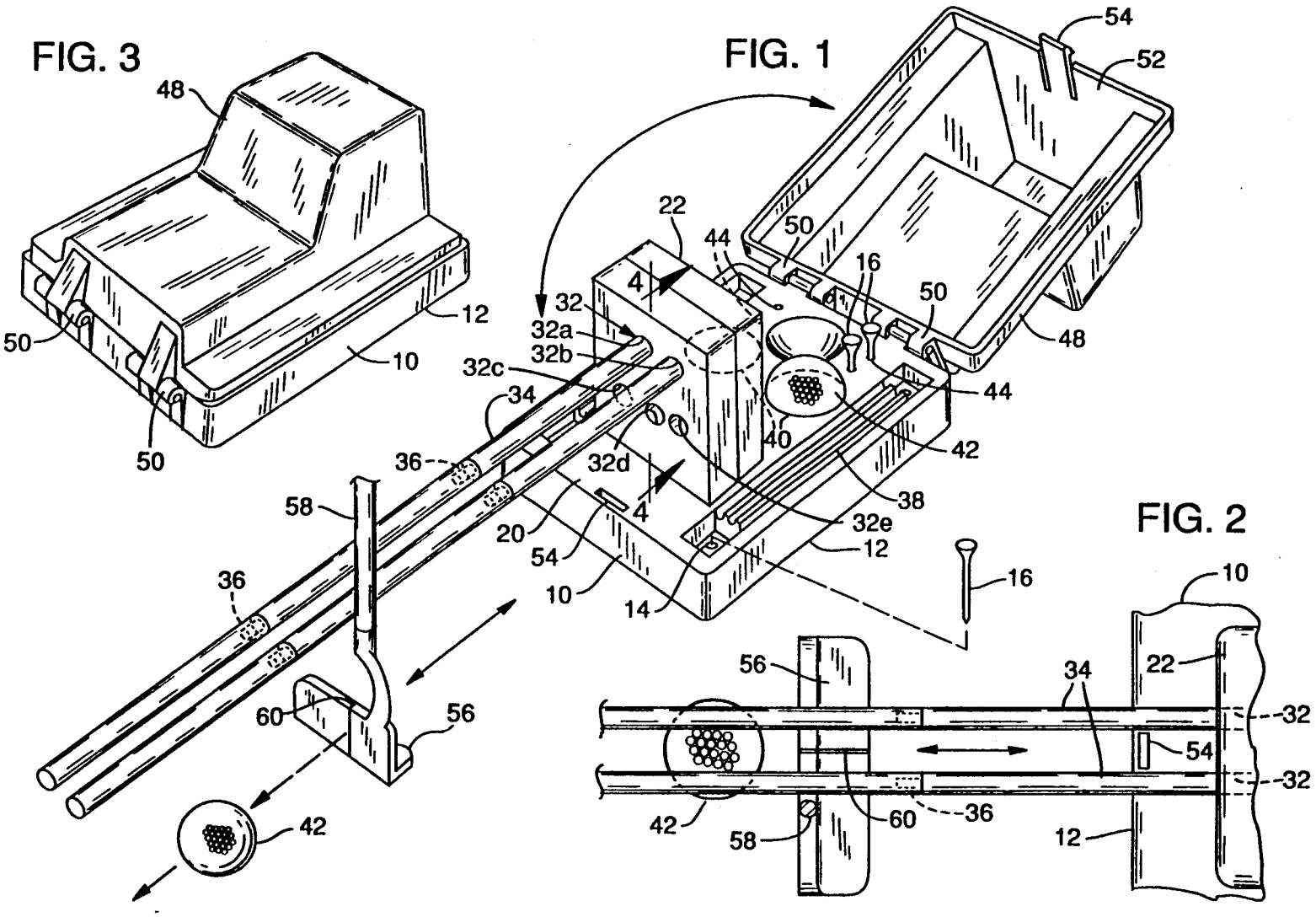
FIG. 1 is a perspective view of a putting aid of my invention.
FIG. 2 is an enlarged fragmentary plan view looking down on guide means of FIG. 1 and showing such guide means, putter head and golf ball as they would be viewed by a person practicing putting.
FIG. 3 is a perspective view of the putting aid in compacted position for shipment or storage.

With reference first to FIGS. 1-3 of the drawings, the instant putting aid has supporting structure similar to that shown in my U.S. Pat. No. 5,037,100, comprising a flat, plate-like base 10 having a bottom support edge or surface 12 that supports the base flatwise on a putting surface. It has corner apertures 14 arranged to receive anchor means 16 if needed such as golf tees or other means for stabilization. The base 10 has a top wall surface 20 which supports a pedestal 22 preferably in rotatably adjustable positions.

Pedestal 22 has a plurality of sockets or attaching holes 32 that have an improved and specific location to be described hereinafter. These sockets receive elongated rods 34, two at a time and hold the rods in outwardly cantilevered projecting position parallel with each other and with the supporting or putting surface. The rods 34 are about one foot to two feet in length to accomplish the desired putting stroke and are segmentally constructed, as by suitable male/female connections 36 which allow them to be broken down into short lengths. The top wall 20 of the base 10 has longitudinal recesses 38 at the sides for storing these compacted rods when not in use. Wall 20 also is provided with recesses 40 to store golf balls 42 and recesses 44 to store the anchor tees 16.

The putting aid has a lid or cover portion 48 with a hinge connection 50 at the rearward end and has an inner contour 52 capable of covering the base including the pedestal 22. When closed, the lid seats on the top wall 20 of the base and has a latch connection 54 therewith for locking connection.

With reference to FIGS. 1 and 2, the device when in use is opened up and a pair of the rods 34 is placed in the respective sockets 32. These rods are supported outwardly in projecting position parallel with the supporting or putting surface. Also, the rods are held on the base at a sufficient height to receive a golf ball and putter head freely thereunder, as will be explained more fully hereinafter. When practicing putting, the golfer places the ball on the putting surface under the rods 34 The head 56 of the putter is also positioned under the rods. The shaft 58 of the putter preferably projects up on the side adjacent the golfer, or it may extend up between the rods, depending upon the construction of the putter and the desire of the golfer. The golfer then retracts the putter in a back swing with the shaft traveling rearwardly in precise parallel movement with the rods. Preferably, the putter shaft does not touch the rods. With this steadying influence for the golfer, he or she will learn to draw the putter back in a straight and unwavy line. After completing the back swing, the putter is moved into its forward swing, still being guided by the rods and without touching the rods if desired. Likewise, the forward swing of the putter is maintained in a straight line, thus inducing the golfer to accomplish a square putting stroke. Putter heads 56 usually have an alignment mark 60 on the top surface thereof which will assist the golfer in moving the putter in a straight line parallel with the rods.

According to the invention and with reference to FIGS. 4, 5, 6 and 7 the front surface of the pedestal has a plurality of mounting means for a pair of the rods comprising sockets 32*a*, 32*b*, 32*c*, 32*d* and 32*e*. Sockets 32*a* and 32*b* are disposed at an upper point in the face of the pedestal 22. These two sockets are similar to those used in the structure shown in my U.S. Pat. No. 5,037,100 for supporting the rods 34 in their cantilevered position and providing a vertical line of sight S down between the rods and viewing the alignment mark 60 on the putter head 56. This function is also apparent in FIG. 2.

Figure 4:
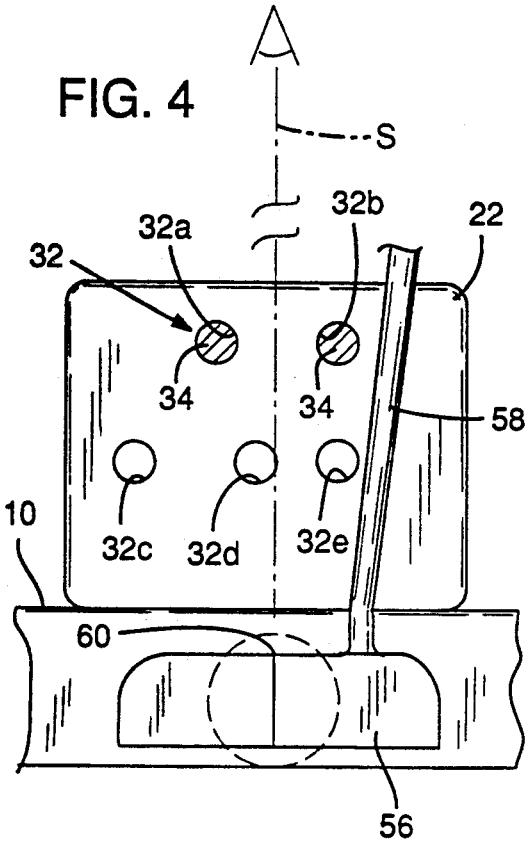
FIG. 4 is a fragmentary front elevational view of a pedestal on a base member of the invention showing the arrangement of mounting means of the invention and guide rods positioned therein for accomplishing one feature of the invention.
Figure 5:
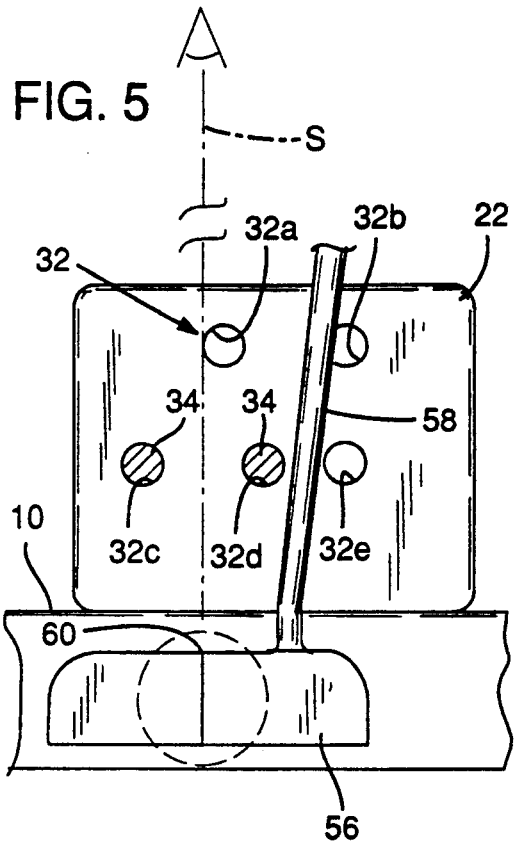
FIGS. 5, 6 and 7 show respective positions of attachment of the guide rods in the mounting means for accomplishing other features of guided putting practice according to the invention.

Sockets 32*c* and 32*d* serve the same function as sockets 32*a* and 32*b* in that they support the rods 34 in approximately the same spacing as sockets 32*a* and 32*b* for guiding the putter in a straight line. However, the two sockets 32*c* and 32*d* are lowered relative to the sockets 32*a* and 32*b*, the purpose of which is to minimize the arc of the putter head that it can take as it is swung in its putting stroke namely, the reduced distance between the rods and the putting surface requires that the arc of the putter head in its backswing and follow-through must be almost horizontal to avoid contacting the rods and the putting surface. The more experienced golfer may desire this feature. On the other hand, the upwardly located position of FIG. 4 while providing some confinement for the arc of travel of the putter head is more generous and does not provide the limits of the structure of FIG. 5. The position of sockets 32*a* and 32*b* may be desired by the inexperienced golfer. Considering that FIGS. 4 and 5 are substantially to scale, it is apparent that spacing between the bottom of rods 34 in FIG. 4 and the putting surface is approximately 6½ centimeters whereas the similar measurement in the present structure of FIG. 5 is approximately 4½ centimeters. Although the invention is not to be limited to these precise measurements, they are substantially preferred measurements that contribute greatly to the function of good putting practice.

Figure 6:
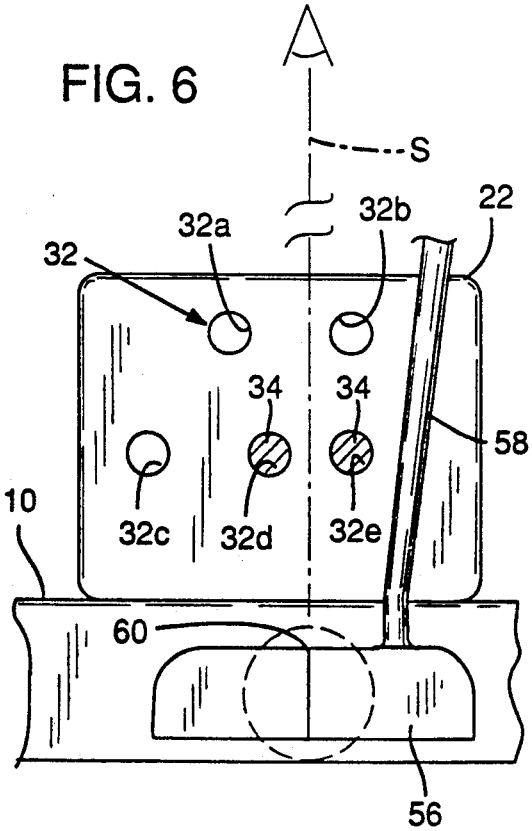

In the function of the device as shown in FIG. 6, the rods 34 are mounted in the sockets 32*d* and 32*e*. The function of sockets 32*d* and 32*e* is to minimize the lateral dimension of the guide path between the rods so that a person using this portion of the putting aid has very little lateral movement available when moving the alignment mark on the putter in the path between the rods. Thus, a substantially straight unwavering putting stroke must be accomplished. Whereas the spacing between the rods 32*a* and 32*b* or 32*c* and 32*d* shown in FIGS. 4 and 5, respectively, is approximately 13 mm, the spacing between the FIG. 6 arrangement is about half that much, namely, about 6 to 7 mm. Here again, the invention is not to be limited to such precise measurements but such comprises preferred spacing.

Figure 7:
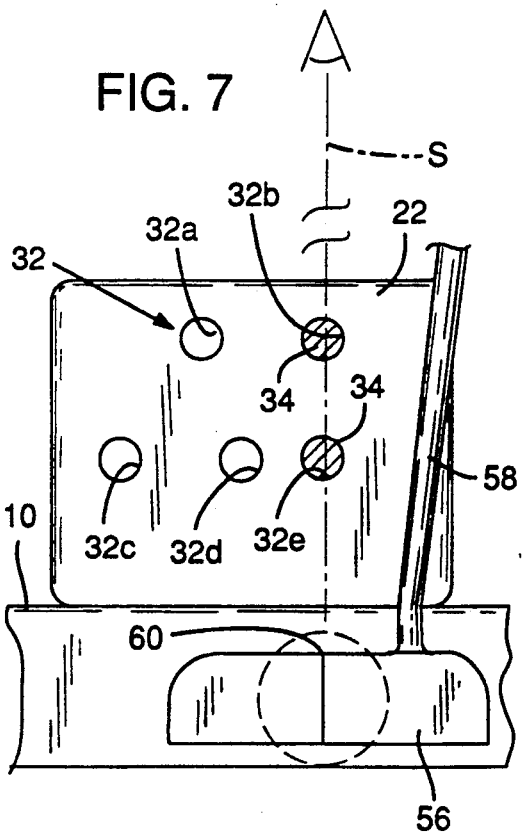

FIG. 7 illustrates the mounting of the rods 34 in sockets 32*b* and 32*e*. These two sockets are disposed in vertical alignment and serve the important function of taking a line of sight S from directly over them to teach the golfer the art of lining his or her eyes vertically over the ball and line of the putt. This is accomplished by placing the ball and the alignment mark on the putter directly under the rods and then adjusting the line of sight such that the lower rod 34 does not appear in the line of sight. Thus, if the golfer is properly aligned with the line of sight over the rods, the lower rod will not be visible.

Thus, according to the invention, means are provided that enable golfers to practice properly for fundamental improvement and reinforcement and with proper and repeated practice, the proper straight line or approximately straight line movement can be accomplished as well as the arc of longitudinal travel of the putter head in its backswing and follow-through movements. Furthermore, the arrangement of FIG. 7 can be utilized to sight directly down over the ball in a preferred manner.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A putting aid comprising:

a base member having front, rear and side portions and arranged to be seated on a supporting surface, and a putter guide on said base member, said putter guide including an upstanding pedestal mounted on said base member having a front surface, said putter guide also including two elongated cooperating straight rods, mounting means for said rods on the front surface of said pedestal comprising a plurality of sockets in said surface capable of removably receiving said rods at one of their ends and providing cantilevered support thereof with the rods projecting from the front surface of said pedestal and also projecting beyond said base member in a plane parallel with said base member, said rods being supported on said pedestal at a height whereby a golf ball on the supporting surface as well as a putter head can be located freely thereunder so that a shaft of the putter can have free uncontacting guiding movement relative to the rods, said rods being of a length whereby a putter head can be guided therealong through a putting stroke while sighting down on the putter head and golf ball in relation to at least one of said rods to encourage a straight line putting impact against the golf ball lying on the supporting surface, and at least two sets of said plurality of sockets in the front surface of said pedestal removably receiving and supporting the two rods selectively therein, said sockets having an arrangement on said pedestal capable of removably receiving and supporting said two rods in at least two different cooperating putter guiding positions.

2. The putting aid of claim 1 wherein two sets of sockets include first and second pairs of horizontally aligned sockets for said rods, said second pair of sockets being disposed at an elevation lower than said first pair of sockets for selectively positioning the two rods at different heights above the putting surface depending upon the desire of the golfer.

3. The putting aid of claim 1 wherein said two sets of sockets include first and second pairs of horizontally aligned sockets for said rods, said first pair of sockets being spaced a greater distance apart horizontally than said second pair of sockets for selectively positioning the two rods at different horizontal spacings relative to each other depending upon the desire of the golfer.

4. The putting aid of claim 1 wherein said two sets of sockets include first and second pairs of horizontally aligned sockets for said rods, said second pair of sockets being disposed at an elevation lower than said first pair of sockets for selectively positioning the two rods at different heights above the putting surface depending upon the desire of the golfer, said second pair of sockets also being spaced a lesser distance apart horizontally than said first pair of sockets for selectively positioning the two rods at different horizontal spacings relative to each other depending upon the desire of the golfer.

5. The putting aid of claim 1 wherein the pair of sockets in at least one set of said sockets is vertically disposed to provide sighting of two rods therein from directly above to teach the golfer to provide eye alignment vertically over a ball placed below the rods in vertical alignment.

* * * * *